US009192804B2

(12) United States Patent
Inglut

(10) Patent No.: US 9,192,804 B2
(45) Date of Patent: Nov. 24, 2015

(54) ISOLATED UPPER-BODY EXERCISE DEVICE

(71) Applicant: Derrick Jeffrey Inglut, Washington, DC (US)

(72) Inventor: Derrick Jeffrey Inglut, Washington, DC (US)

( * ) Notice: Subject to any disclaimer, the term of this patent is extended or adjusted under 35 U.S.C. 154(b) by 96 days.

(21) Appl. No.: 13/673,903

(22) Filed: Nov. 9, 2012

(65) Prior Publication Data

US 2014/0135182 A1 May 15, 2014

(51) Int. Cl.

| | |
|---|---|
| ***A63B 1/00*** | (2006.01) |
| ***A63B 21/068*** | (2006.01) |
| ***A63B 21/00*** | (2006.01) |
| ***A63B 23/12*** | (2006.01) |

(52) U.S. Cl.

CPC ..... *A63B 21/068* (2013.01); *A63B 21/00047* (2013.01); *A63B 21/1469* (2013.01); *A63B 23/1227* (2013.01); *A63B 2208/029* (2013.01); *A63B 2225/093* (2013.01)

(58) Field of Classification Search

CPC ..... A63B 2023/0411; A63B 2023/01; A63B 21/1453; A63B 21/1457; A63B 2021/0783; A63B 2021/0786; A63B 21/00047; A63B 21/00138; A63B 21/00149; A63B 21/00167; A63B 21/0017; A63B 21/00174; A63B 21/00185; A63B 21/06; A63B 21/068; A63B 21/14; A63B 21/1403; A63B 21/1415; A63B 21/1434; A63B 21/1465; A63B 21/1469; A63B 21/1476; A63B 23/035; A63B 23/12; A63B 23/1209; A63B 23/1218; A63B 23/1227; A63B 2208/029; A63B 2225/093

USPC ..... 482/96, 92–95, 23, 38–42, 140, 141, 482/142, 143

See application file for complete search history.

(56) References Cited

U.S. PATENT DOCUMENTS

| | | | | |
|---|---|---|---|---|
| 4,620,701 | A * | 11/1986 | Mojden | 482/41 |
| 5,417,628 | A | 5/1995 | Vanderbleek | |
| 5,776,037 | A * | 7/1998 | Millington | 482/91 |
| 5,840,001 | A * | 11/1998 | Schedel | 482/142 |
| 6,645,130 | B2 * | 11/2003 | Webber | 482/142 |
| D633,156 | S * | 2/2011 | Caswell et al. | D21/679 |
| 8,535,204 | B2 * | 9/2013 | Stacey | 482/40 |
| 2008/0200317 | A1 * | 8/2008 | Campanaro et al. | 482/140 |
| 2010/0234193 | A1 * | 9/2010 | Friedman et al. | 482/133 |
| 2012/0225759 | A1 | 9/2012 | Tsai | |

OTHER PUBLICATIONS

Nick Nilsson, Bodyweight Preacher Curls for Thrashing your Biceps, BetterU News, Jun. 5, 2008, pages N/A, Issue 8, Nick Nilsson, Internet publication—http://www.fitstep.com/Misc/Newsletter-archives/issue60/preacher-curls.htm.

* cited by examiner

*Primary Examiner* — Oren Ginsberg
*Assistant Examiner* — Megan Anderson

(57) ABSTRACT

An exercise device for training the Biceps, Posterior Deltoids and Latissimus Dorsi using an exerciser's body weight that has a support pad and a fixed curl bar on a frame at an elevated position. The exerciser grasps the curl bar, rests his or her forearms on the support pad and lift his or her body to perform the exercise.

4 Claims, 11 Drawing Sheets

ISOLATED UPPER-BODY EXERCISE DEVICE

BACKGROUND

1. Field of the Invention

This invention relates to exercise devices. Specifically those exercise devices that provide targeted anaerobic exercise through the use of the exerciser's body weight.

2. Description of Prior Art

Physical exercise provides well known benefits. When performed properly and on a regular basis, physical exercise helps individuals control weight, combat health conditions and diseases, improve emotional well-being, increase energy and improve sleep.

Although overlap is common, athletes generally categorize exercises into aerobic exercise and anaerobic exercise. Aerobic exercise improves the strength and efficiency of the exerciser's cardiovascular and pulmonary systems. Anaerobic exercise increases the efficiency and number of muscle fibers affected by a particular exercise.

Because anaerobic exercise primarily affects the muscle fibers targeted by a particular exercise, exercisers often perform exercises that isolate and target a particular muscle group.

Exercisers and athletes often attempt to train muscle groups in a manner that allows them to develop muscle fibers while improving their cardiovascular health. This type of training often involves performing several different anaerobic exercises with little or no rest between exercises. An example of this type of training is the Cross Fit style of training. Cross Fit requires an exerciser to perform, for example, push-up followed immediately by pull-ups and other compound exercises.

A variety of exercise devices have been developed to help exercisers isolate and target a particular muscle group. These devices often use an additional component to provide resistance during an exercise. For example, U.S. Pat. No. 6,746,382 B2 describes a device for targeting an exerciser's quadriceps and relies on elastic bands to provide resistance.

A variety of exercise devices have been developed that rely on the exerciser's body weight for resistance. U.S. Pat. No. 7,892,157 B2 discloses an exercise device that allows the exerciser to perform a variety of exercises using his or her body weight as resistance. While U.S. Pat. No. 7,892,157 B2 relies on body weight for resistance, it does not support the exerciser's body in a manner that prevents the exerciser's non-targeted muscle groups from assisting in an exercise.

Devices that isolate the biceps are common in the prior art. U.S. Pat. No. 5,256,125 discloses a biceps curling machine. The device successfully targets the exerciser's biceps, but has the disadvantages of requiring a large mechanical frame and heavy metallic weights for resistance and it fails to develop the exerciser's Posterior Deltoids and Latissimus Dorsi. These devices also have the disadvantage of requiring time to set up and, therefore, preventing the exerciser from combining aerobic and anaerobic training.

SUMMARY

The invention disclosed in an exercise device that targets the exerciser's biceps and supporting muscle groups while using the exerciser's body weight as resistance.

OBJECTS AND ADVANTAGES

A person's body weight can provide significant resistance during exercise. The U.S. military services, for example, use a combination of push-ups, pull-ups and sit-ups as a significant portion of their strength training programs for new recruits. Therefore, the proposed invention has the following intentions a) To provide a device that targets the exerciser's biceps, posterior deltoids and latissimus dorsi b) To provide the exerciser with the opportunity to perform exercises without the need for heavy metallic weights or elastic bands with varying resistance c) To provide the exerciser with the opportunity to exercise his or her biceps without needing to spend time adjusting or setting up the exercise device d) To offer a device that allows the exerciser to train his or her biceps, posterior deltoids and latissimus dorsi while being able to quickly transition to other exercises

BRIEF DESCRIPTION OF THE SEVERAL VIEWS OF THE DRAWINGS

Overview:

All the drawings are listed as FIGS. 1 through 8. Each part in the drawings is numbered 100 through 900.

REFERENCE NUMERALS IN DRAWINGS

100—The preferred embodiment of the device
200—The frame of the device
201—The first rigid member
202—The second rigid member
203—The left-most rigid member
204—The right-most rigid member
205—The left-most horizontal rigid member
206—The right-most horizontal rigid member
207—The left-most angled rigid member
208—The right-most angled rigid member
209—The third rigid member
210—The left-most pad support rigid member
211—The right-most pad support rigid member
212—The fourth rigid member
213—The fifth rigid member
300—The support pad
400—The curl bar
500—The mounting means
600—A stand-alone embodiment of the exercise device
601—The support base for the stand-alone embodiment of the exercise device
602—The left-most frame extension of the stand-alone embodiment of the exercise device
603—The right-most frame extension of the stand-alone embodiment of the exercise device
604—The left-most pad support of the stand-alone embodiment of the exercise device
605—The right-most pad support of the stand-alone embodiment of the exercise device
606—The horizontal rigid member of the stand-alone embodiment of the exercise device
607—The right-most angled rigid member of the stand-alone embodiment of the exercise device
608—The left-most angled rigid member of the stand-alone embodiment of the exercise device

LIST OF FIGURES

Figure 1:
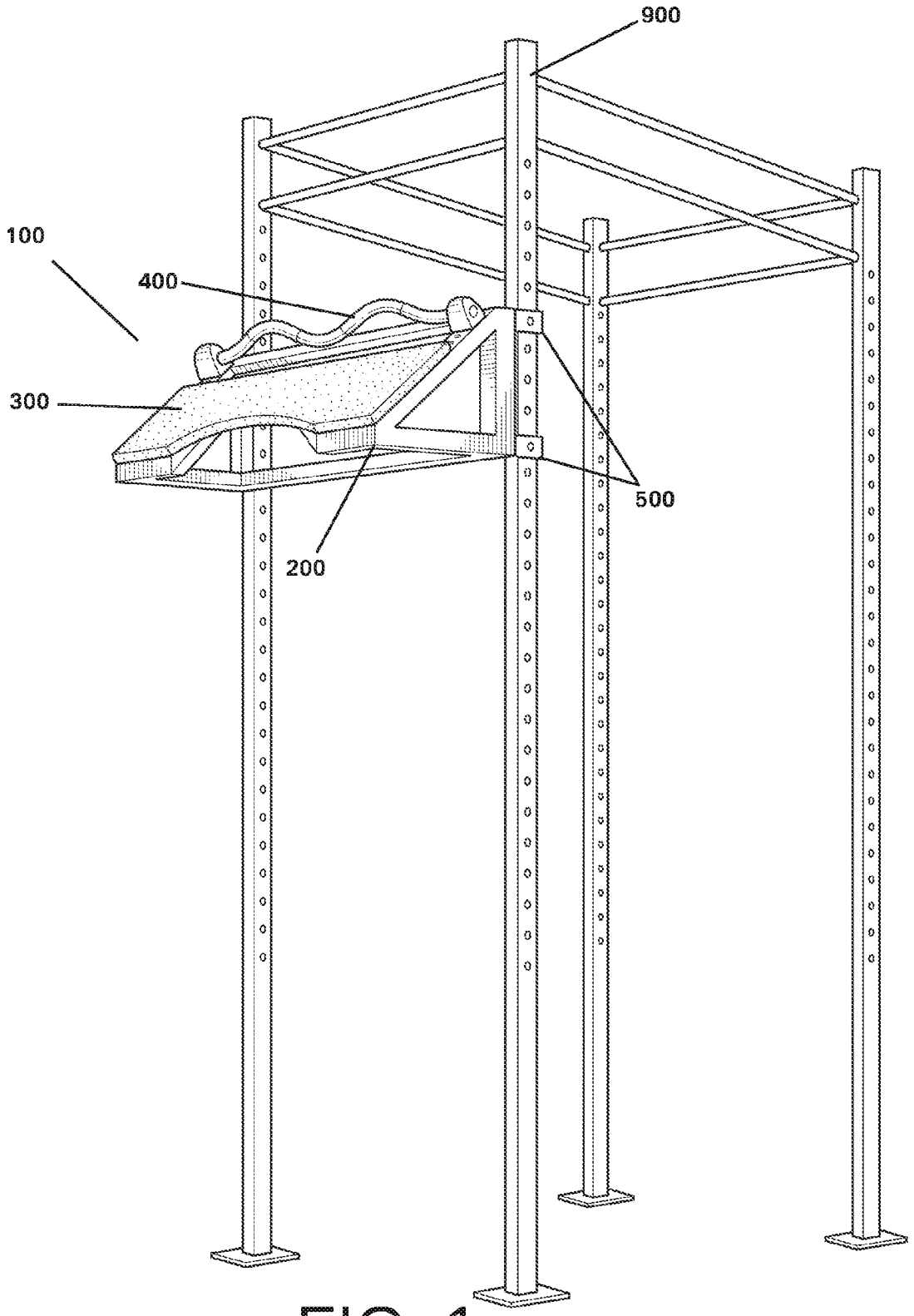
Figure 2:
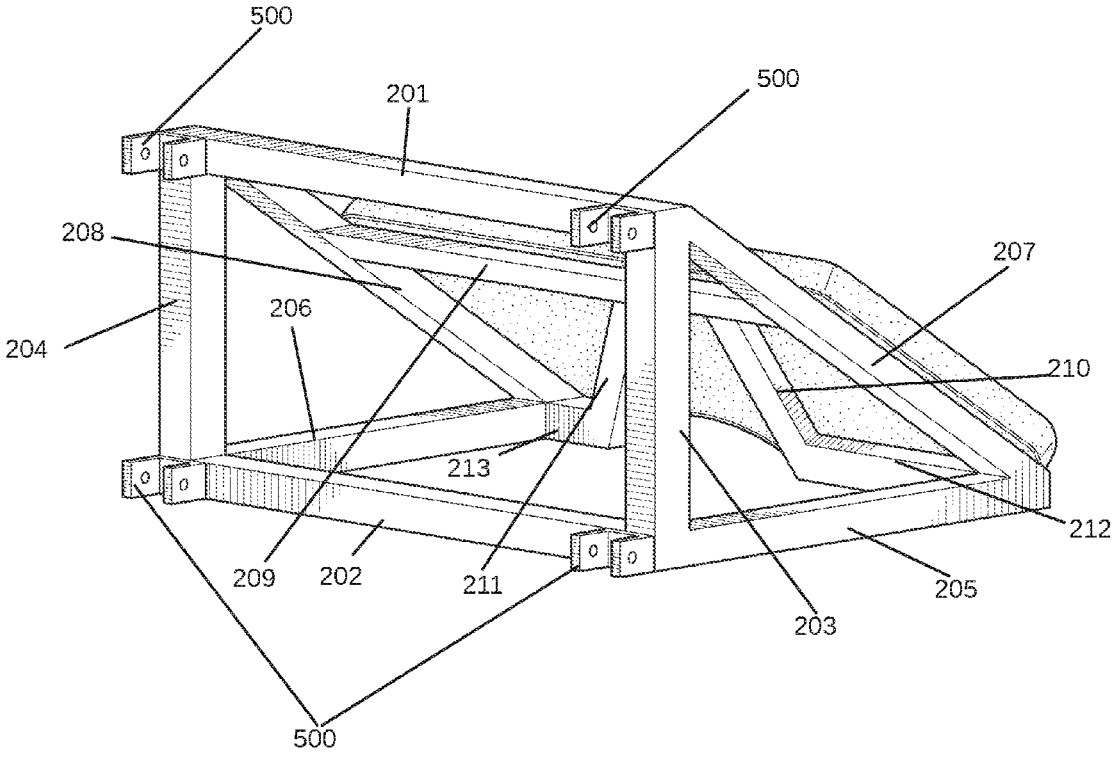
Figure 3:
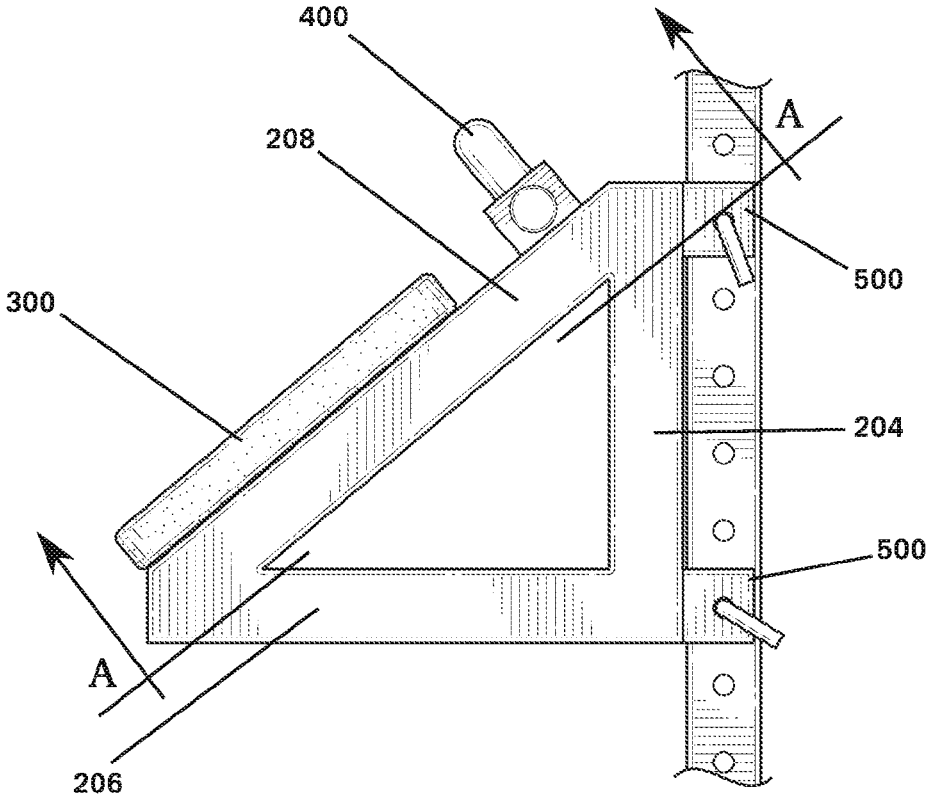
Figure 4:
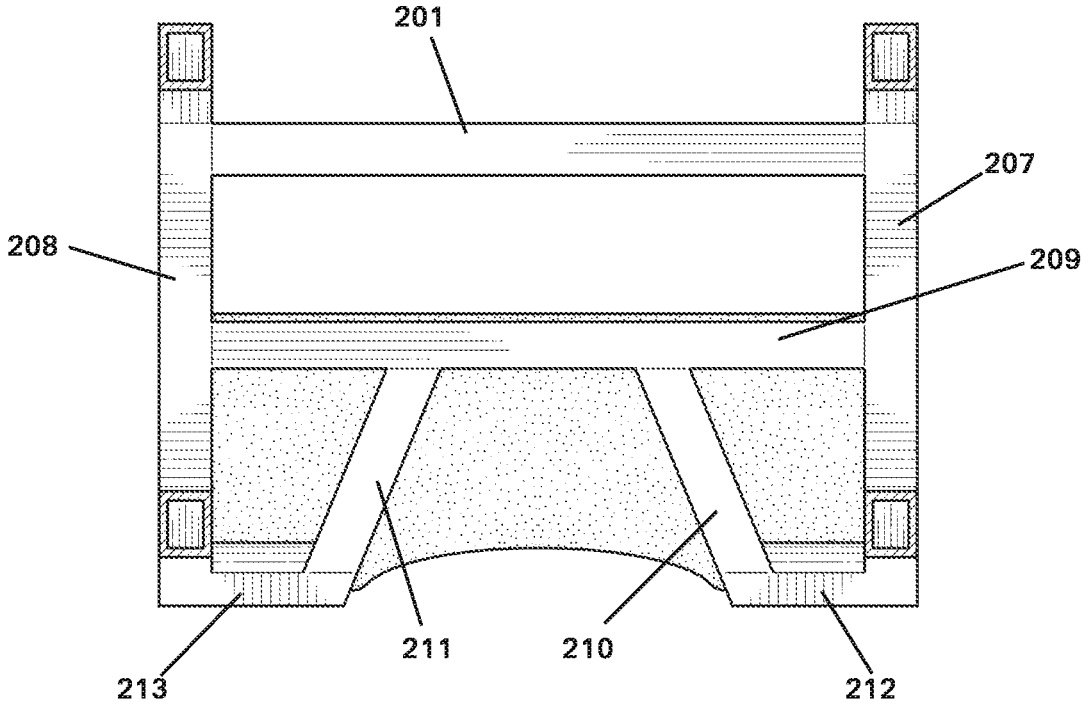
Figure 5:
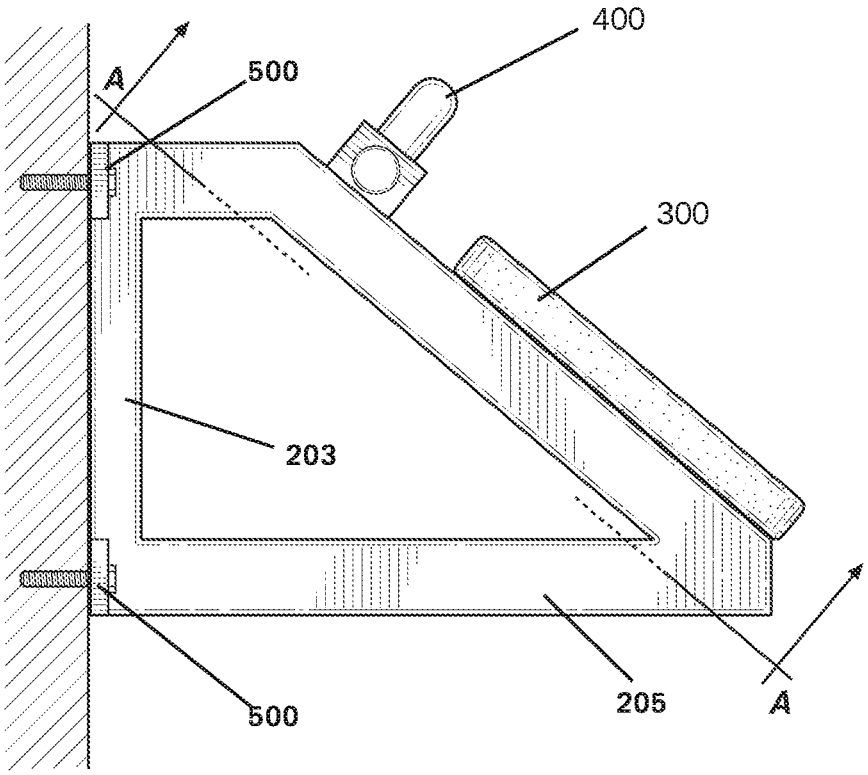
Figure 6:
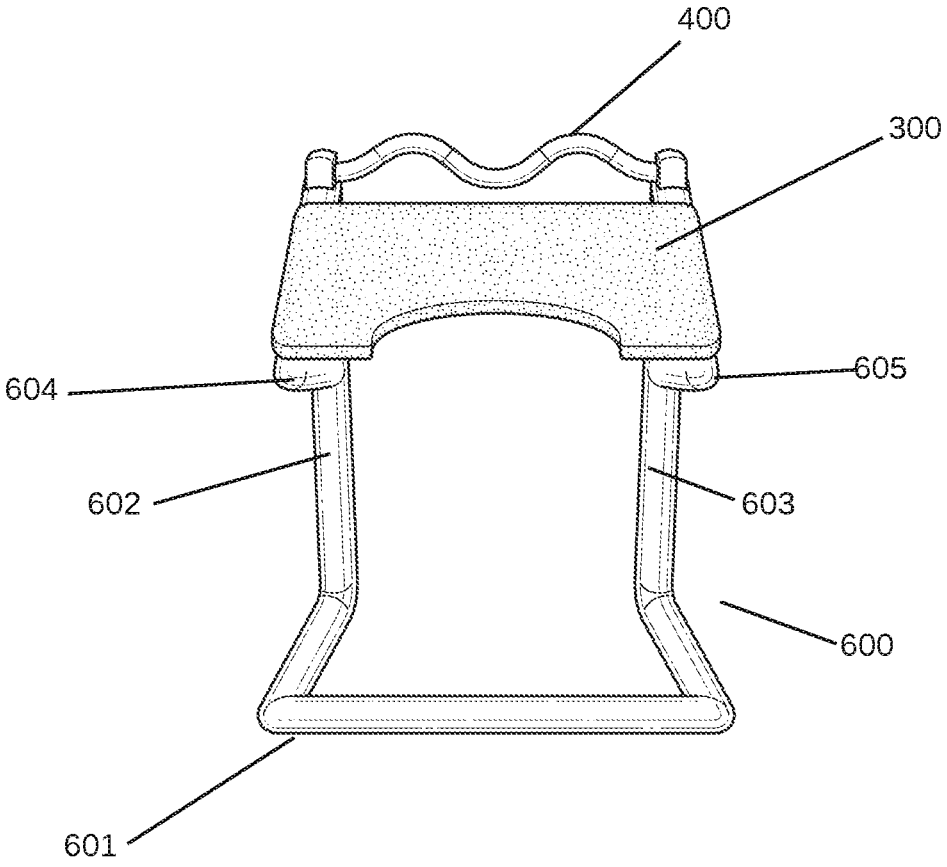
Figure 7:
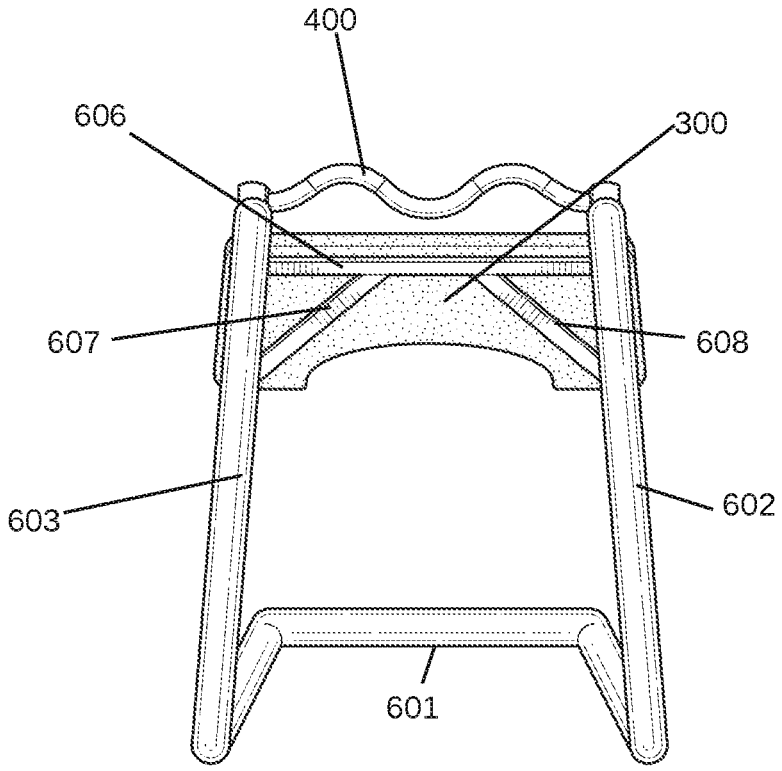
Figure 8:
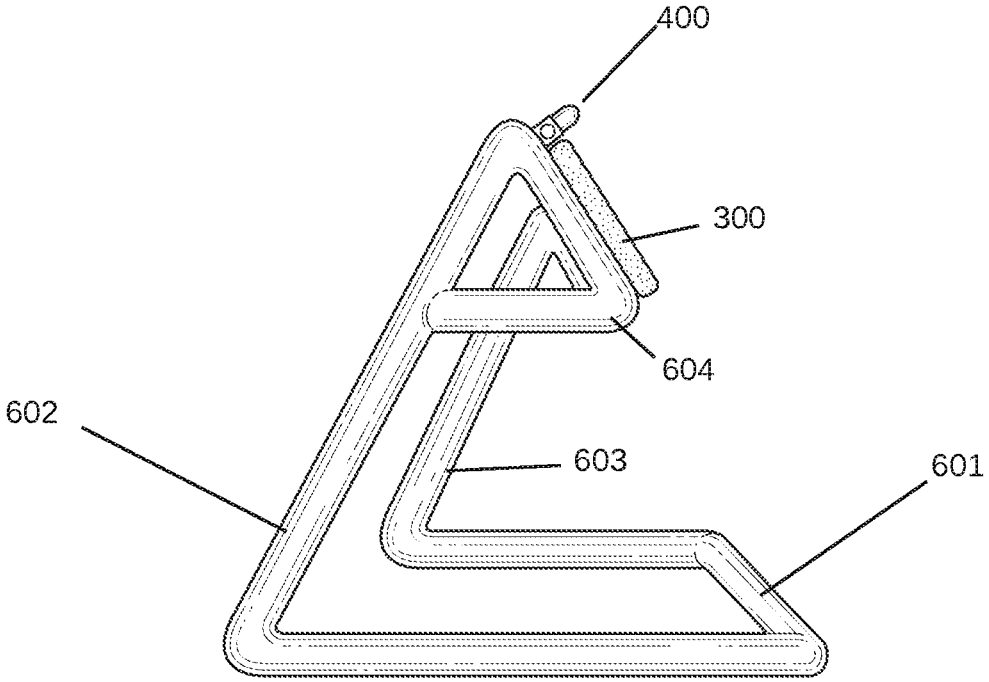
Figure 9:
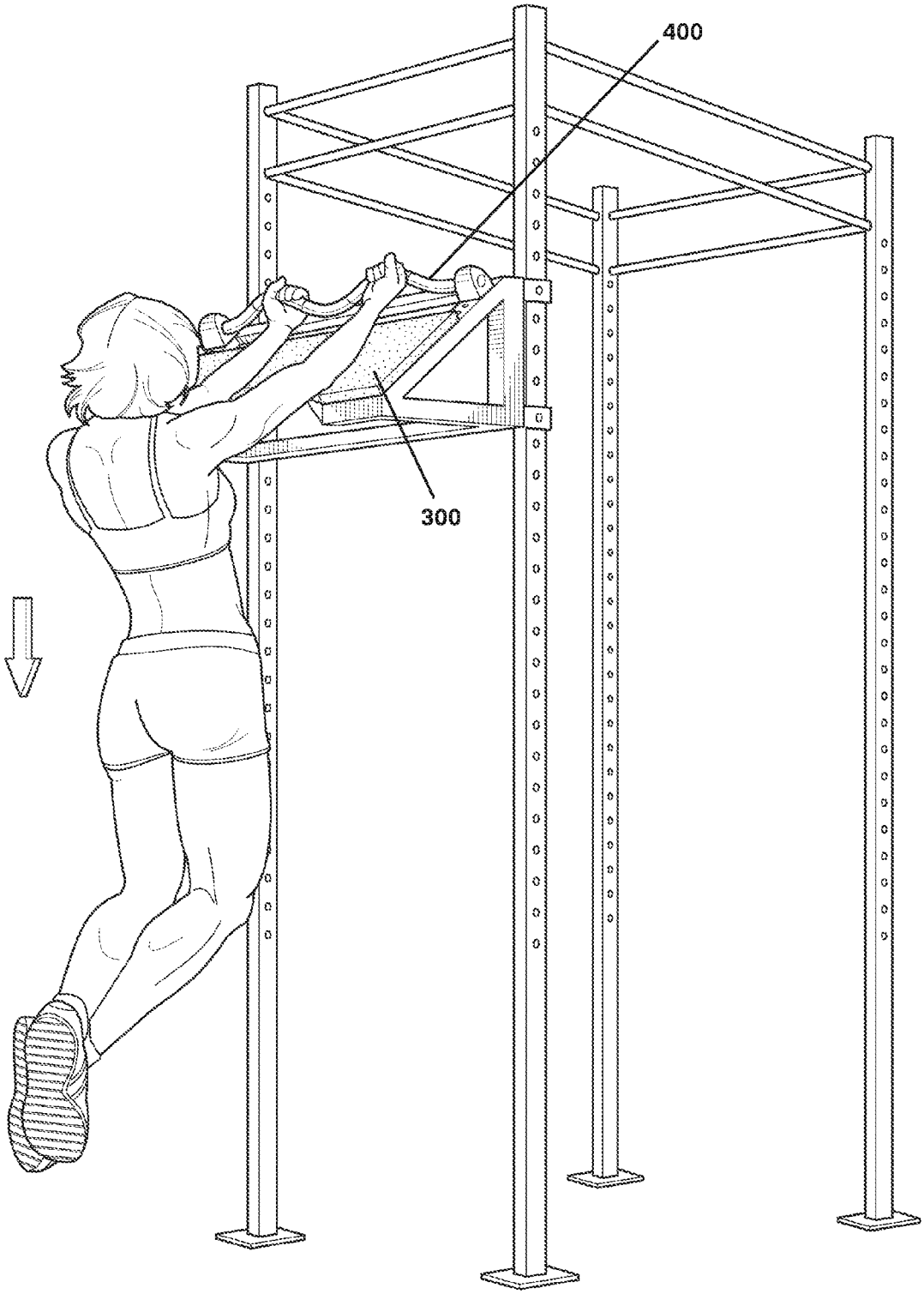
Figure 10:
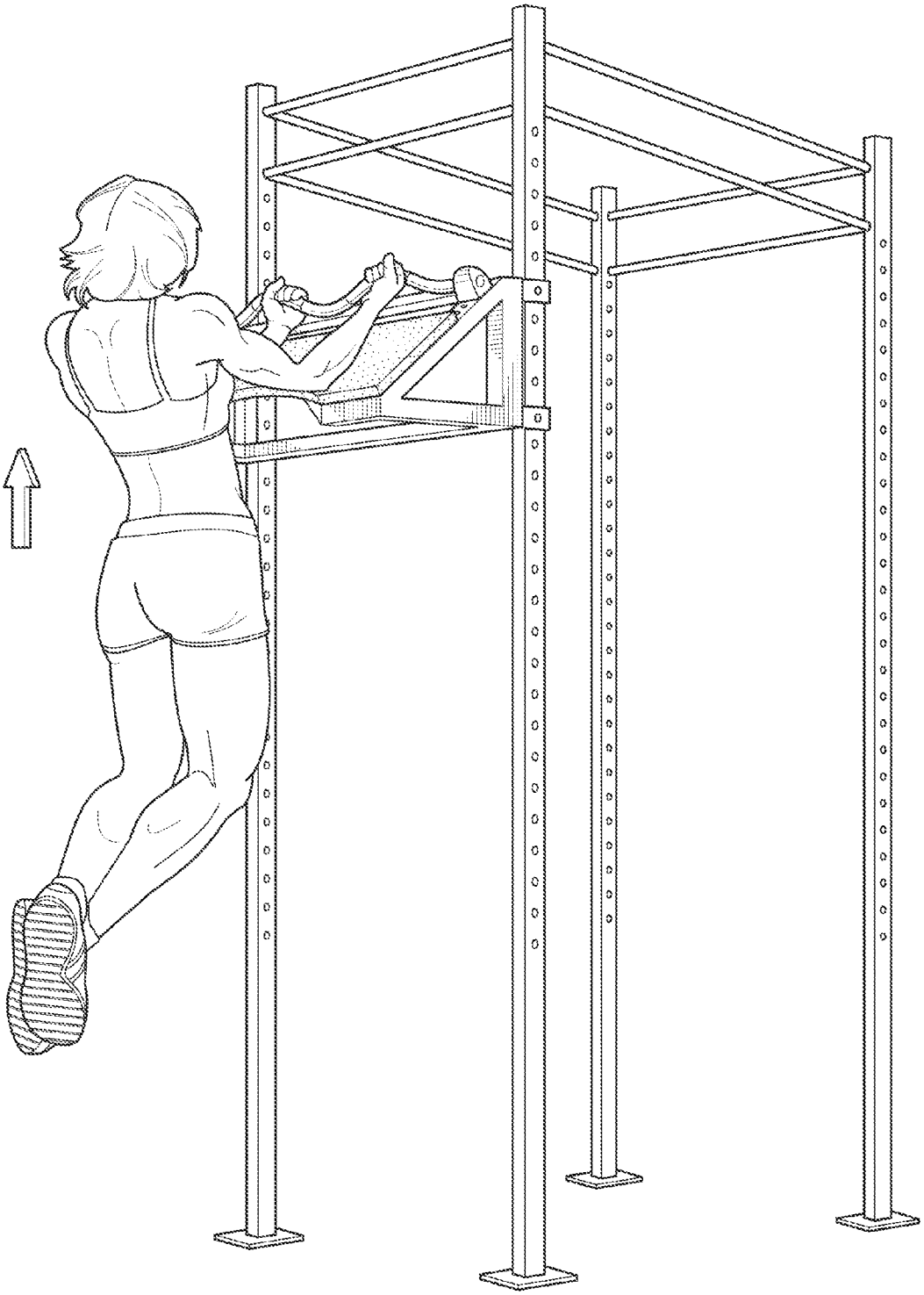
Figure 11:
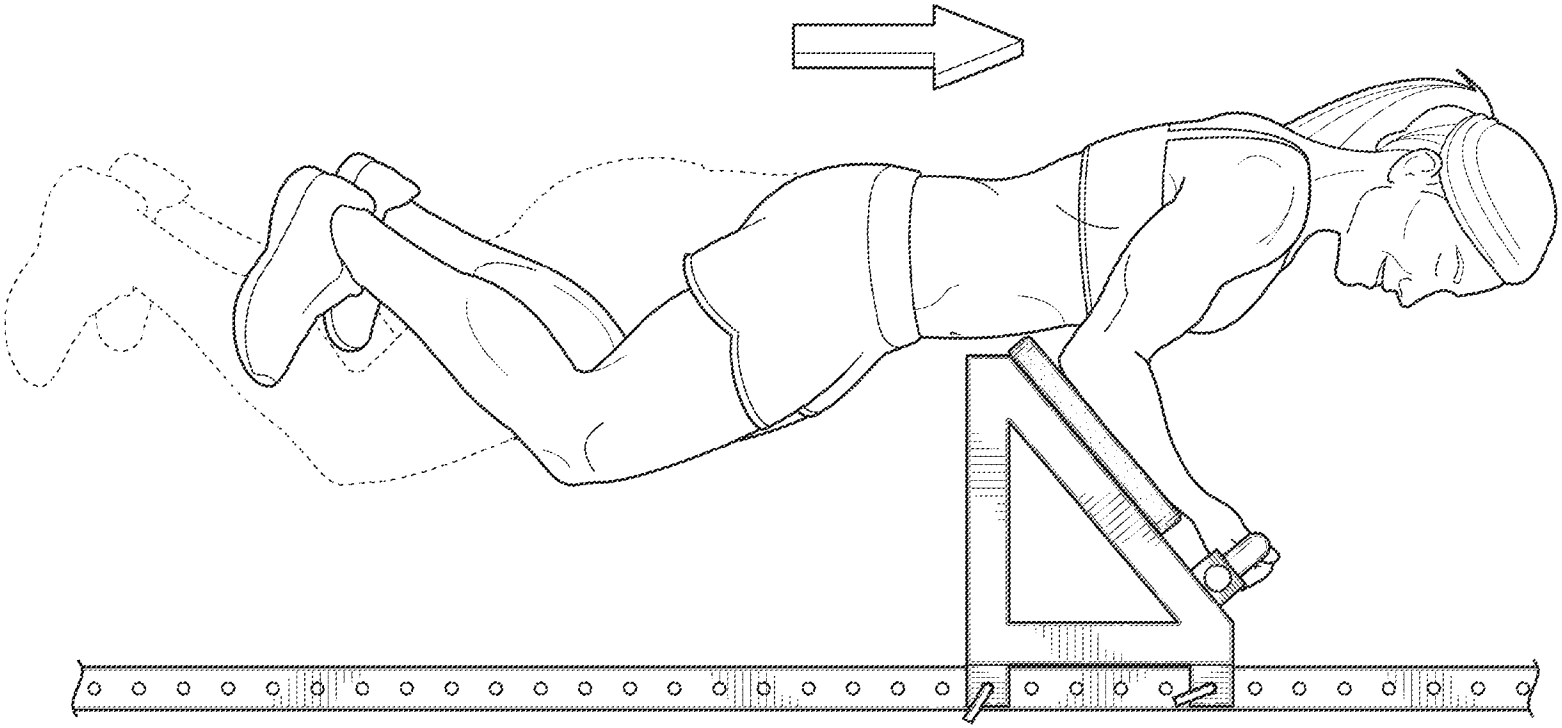

FIG. 1 depicts an example of the exercise device mounted on an exercise cage FIG. 2 depicts an example of the exercise device as viewed from a rear Perspective FIG. 3 depicts an example of the exercise device as viewed from a side profile and mounted onto an exercise cage FIG. 4 represents view A-A as defined in FIG. 3 and depicts an example of the device's pad support structure FIG. 5 depicts an example of the exercise device as viewed from a side profile and mounted onto a wall FIG. 6 depicts the front view of the exercise device as a stand-alone unit FIG. 7 depicts the rear view of the exercise device as a stand-alone unit FIG. 8 depicts the side view of the exercise device as a stand-alone unit FIG. 9 depicts an example of the exercise device mounted on an exercise cage with an exerciser at the beginning stage of the exercise FIG. 10 depicts an example of the exercise device with an exerciser approaching the finishing position of the exercise FIG. 11 depicts an example of the exercise device viewed from the side with an exerciser approaching the finishing position of the exercise.

DETAILED DESCRIPTION OF THE INVENTION

The following description provides specific details and a thorough understanding of the embodiments of the invention. One skilled in the relevant art, however, will recognize that the invention can be practiced without one or more of the specific details or in combination with other components.

FIG. 1 depicts an example of the exercise device 100 mounted onto an exercise cage 900. The example exercise device 100 includes a frame assembly 200, a support pad 300, a curl bar 400 and mounting provisions 500.

FIG. 2 is a rear perspective view of an example of the exercise device 100. The example exercise device 100 includes a frame assembly 200 with a first rigid member 201, a second rigid member 202, a left-most rigid member 203, a right-most rigid member 204, a left-most horizontal rigid member 205, a right-most horizontal rigid member 206, a left-most angled rigid member 207, a right-most angled rigid member 208, a third rigid member 209, a left-most pad support rigid member 210, a right-most pad support rigid member 211, a fourth rigid member 212 and a fifth rigid member 213.

In the preferred embodiment, the first rigid member 201, second rigid member 202 and third rigid member 209 will be of equal length. However, one skilled in the art will recognize that the first rigid member 201, second rigid member 202 and third rigid member 209 may be cut to any suitable length to satisfy a particular application. For example, larger cuts may be used to target men while smaller cuts may be used to target women.

In the preferred embodiment, the first rigid member 201 and second rigid member 202 are horizontally oriented, spaced a distance apart and on the same plane. The left-most rigid member 203 is joined to the left-most ends of both the first rigid member 201 and the second rigid member 202. The right-most rigid member 204 is joined to the right-most ends of both the first rigid member 201 and the second rigid member 202. When viewed from the rear, the joined first rigid member 201, second rigid member 202, left-most rigid member 203 and right-most rigid member 204 will form a generally square or rectangular shape.

Continuing with the preferred embodiment, FIG. 3 depicts a side profile of the exercise device. As shown in FIG. 3, the right-most horizontal rigid member 206 is joined at the junction of the second rigid member 202 and the right-most rigid member 204. The right-most angled rigid member 208 is joined with both the right-most horizontal rigid member 206 and at the junction of the right-most rigid member 204 and the first rigid member 201. Similarly, as shown in FIG. 2 the left-most horizontal rigid member 205 is joined at the junction of the second rigid member 202 and the left-most rigid member 203. The left-most angled rigid member 207 is joined with both the left-most horizontal rigid member 205 and at the junction of the left-most rigid member 203 and the first rigid member 201. When viewed from the side and as depicted in FIG. 3, the joined right-most horizontal rigid member 206, right-most rigid member 204 and right-most angled rigid member 208 will form a generally triangular shape. Similarly, the joined left-most horizontal rigid member 205, left-most rigid member 203 and left-most angled rigid member 207 will form a generally triangular shape. In the preferred embodiment, the angle formed between the left-most angled rigid member 207 and the left most horizontal rigid member 205 will be between 45 and 50 degrees. This angle has been determined to provide maximum benefit from the exercise while promoting safe usage of the device.

FIG. 4 depicts the view A-A as defined in FIG. 3. FIG. 4 depicts the pad support portion of the exercise device's frame. In the preferred embodiment, the fourth rigid member 212 is joined at the junction of left-most angled rigid member 207 and the left-most horizontal rigid member 205. Similarly, the fifth rigid member 213 is joined at the junction of the right-most angled rigid member 208 and the right-most horizontal rigid member 204. The third rigid member 209 is located a distance between the first rigid member 201 and both the fourth rigid member 212 and the fifth rigid member 213 and joined with the left-most angled rigid member 207 and the right-most angled rigid member 208. The left-most pad support rigid member 210 is joined with the third rigid member 209 and the fourth rigid member 212. Similarly, the right-most pad support rigid member 211 is joined with the third rigid member 209 and the fifth rigid member 213. When viewed from view A-A, the joined third rigid member 209, fourth rigid member 212, fifth rigid member 213, left-most pad support member 210 and right-most pad support rigid member 211 will form a trapezoidal shape with a missing base.

While the combination of joined third rigid member 209, fourth rigid member 212, fifth rigid member 213, left-most pad support member 210 and right-most pad support rigid member 211 will form a trapezoidal shape with a missing base in the preferred embodiment, one skilled in the art will recognize that this feature is preferred but not necessary for the device. The exercise device will function with the fourth rigid member 212 and the fifth rigid member 213 joined as a single rigid member spanning the distance between the left-most angled rigid member 207 and the right-most angled rigid member 208 and with the left-most pad support rigid member 210 and right-most pad support rigid member 211 removed from the device.

As depicted in FIG. 3 and FIG. 2., a support pad 300 is mounted onto the structure formed by the right-most angled rigid member 208, the left-most angled rigid member 207, the third rigid member, 209, the fourth rigid member 212, the fifth rigid member 213, left-most pad support member 210 and right-most pad support member 211. The support pad 300 can be made with any material, but will preferably be made with a wooden support material covered with foam and vinyl as is typical in the art to cushion the exerciser's arms. In the preferred embodiment, the support pad will contain a cut-out on the side closest to the fourth rigid member 212 and fifth rigid member 213 and parallel to the third rigid member 209. The cut-out will be sized to provide enough space so that an exerciser's stomach does not prevent the exerciser from performing the exercise in a full range of motion.

As depicted in FIG. 1, the exercise device will have a curl bar 400 that spans the distance between the left-most angled rigid member 207 and the right-most angled rigid member 208. The curl bar 400 is mounted on to the left-most angled rigid member 207 and the right-most angled rigid member 208. In the preferred embodiment, the curl bar 400 is curved to support an exerciser's wrists in a manner commonly known as an EZ curl bar. However, the curl bar 400 can be straight or contain any variety of angles.

FIG. 1 depicts the exercise device mounted onto a functional training cage 900. The exercise cage 900 depicted in FIG. 1 is an example of exercise cages that are common in the art. The exercise cage 900 generally consists of several rigid members with sets of coaxial holes spaced a distance apart. The device is mounted onto the functional training cage 900 by mounting provisions 500. In the preferred embodiment, the mounting provisions 500 are joined at the junctions of the first rigid member 201, the left-most rigid member 203 and right-most rigid member 204 as well as at the junctions of the second rigid member 202, the left-most rigid member 203 and right-most rigid member 204. In the preferred embodiment, the mounting provisions will consist of two coaxial holes that will accept a pin, bolt or rod that will support the device and the weight of the exerciser. The coaxial holes in the exercise device will be aligned with the coaxial holes in the exercise cage 900 and a pin, bolt or rod will pass through both the coaxial holes in the exercise cage 900 and the exercise device's mounting provisions 500 in order to support the weight of the device and the exerciser. Alternative embodiments include a wall mounted version of the device as depicted in FIG. 5. As depicted in FIG. 5, the mounting provisions 500 are joined to the device with the device supported on a wall by a series of screws or bolts.

FIG. 6 depicts an alternate embodiment of the exercise device where the device is a fixed stand-alone unit. As shown in FIG. 6, the support pad 300 and curl bar 400 are mounted onto the fixed stand-alone unit. The frame 600, as depicted, consists of a support base 601, left-most frame extension 602, right-most frame extension 603, left-most pad support 604 and right-most pad support arm 605. As depicted in FIG. 8, the support base 601 extends a distance sufficient to assure that the device remains upright when being used. The left-most frame extension 602 and right-most frame extension 603 are joined to the support base 601 and extend a height sufficient to allow a user to perform the exercise without touching the ground.

As depicted in FIG. 8, the left-most frame extension 602 and right-most frame extension 603 are joined to the support base 601 at an angle that positions the user over the support base 601. The left-most pad support arm 604 is joined with the left-most frame extension 602 at the end opposite of the support base 601 and forms an angle preferably between 45 and 55 degrees from the ground. Similarly, the right-most pad support arm 605 is joined with the right-most frame extension 603 at the end opposite of the support base 601 and forms an angle preferably between 45 and 55 degrees from the ground. In this alternate embodiment, the left-most pad support arm 604 and right-most pad support arm 605 are formed so that there are horizontal components that rejoin the left-most frame extension 602 and right-most frame extension 603, respectively, at positions between the opposing ends of the left-most frame extension 602 and right-most frame extension 603. The horizontal components of the left-most pad support 604 and right-most pad support 605 are intended to provide additional structural support for the exercise device. However, one skilled in the art will recognize that the horizontal components of the left-most pad support 604 and right-most pad support 605 are not absolutely necessary for the exercise device.

FIG. 7 depicts a rear view of this alternate embodiment of the device. As seen in FIG. 7, a horizontal rigid member 606 is joined to the left-most pad support 604 and right-most pad support 605. A right-most angled rigid member 607 is joined to the horizontal rigid member 606 and the right-most pad support 605. Similarly, a left-most angled rigid member 608 is joined to the horizontal rigid member 606 and the left-most pad support 604. The support pad 300 is mounted onto the left-most pad support 604 and right-most pad support 605 and is structurally supported by the horizontal rigid member 606, right-most angled rigid member 607 and left-most angled rigid member 608. The curl bar 400 is mounted onto the left-most pad support 604 and right-most pad support 605.

Although FIGS. 6, 7 and 8 depict the left-most frame extension 602 and right-most frame extension 603 as attached to the end of the support base 601 and forming an angle to position the user over the support base 601, one skilled in the art will recognize that the left-most frame extension 602 and right-most frame extension 603 can be vertical and positioned anywhere on the support base 601 that will maintain the device in the upright position.

Although three embodiments of the exercise device are described, one skilled in the art will recognize that this invention includes any embodiment that the support pad 300 and curl bar 400 to be placed in an elevated position so that the exerciser can grasp the curl bar, rest his or her forearms on the support pad and lift himself or herself from the ground. These other embodiments of the device include, but are not limited to, mounting the device onto a doorway, wall, or other exercise device. One skilled in the art will recognize that the device can be mounted by any means necessary to accomplish a particular mounting goal.

FIG. 9 depicts an exerciser using the preferred embodiment of the device. The exerciser will grasp the curl bar 400 and rest his or her elbows and forearms on the support pad 300. As shown in FIG. 10, the exerciser will contract his or her forearms, biceps, shoulders and back muscles in an effort to lift herself until her arms are fully contracted. FIG. 11 depicts the upper and lower positions of the exerciser while using the device.

I claim:

1. An exercise device for performing muscle building exercises using an exerciser's body weight as resistance comprising:

a frame, said frame having one or more pairs of coaxial holes capable of accepting bolts or pins for mounting the exercise device in an elevated position onto an exercise cage, a fixed support pad and a curl bar, wherein said curl bar is mounted onto said frame in a fixed position above said support pad such that when the exerciser uses the device, she can grasp said curl bar, rest her forearms on said support pad, contract the muscles on her arms, shoulders and back and lift herself from the ground, and wherein said support pad is mounted onto said frame at an angle between 45 and 55 degrees as measured from the intersection between a horizontal plane parallel to level ground and a vertical plane perpendicular to level ground and bisecting both the support pad and the curl bar wherein the initial side of the angle is defined from the exerciser toward the curl bar and parallel to the horizontal plane.

2. The exercise device of claim 1 wherein the support pad further comprises a cut-out sized so as to provide space for the exerciser's stomach as she contracts her arms, shoulders and back muscles and lifts herself from the ground.

3. The exercise device of claim 1 wherein said frame comprises:

a first rigid member having left-most and right-most ends, a second rigid member having left-most and right-most ends, said second rigid member being parallel to the first rigid member, a left-most rigid member having a top end and a bottom end, said top end of the left-most rigid member being joined to the left-most end of the first rigid member, said bottom end of the left-most rigid member being joined to the left-most end of the second rigid member, a right-most rigid member having a top end and a bottom end, said top end of the right-most rigid member being joined to the right-most end of the first rigid member, said bottom end of the right-most rigid member being joined to the right-most end of the second rigid member, a left-most horizontal rigid member joined to the bottom end of the left-most rigid member and joined to the left-most end of the second rigid member, said left-most horizontal rigid member forming a right angle with both the left-most and second rigid members, a right-most horizontal rigid member joined to the bottom end of the right-most rigid member and joined to the right-most end of the second rigid member, said right-most horizontal member forming a right angle with both the right-most and second rigid members, a left-most angled rigid member joined to the left-most end of the first rigid member and the left-most horizontal rigid member, a right-most angled member joined to the right-most end of the first rigid member and the right-most horizontal rigid member, a third rigid member having left-most and right-most ends, said left-most end of the third rigid member being joined to the left-most angled rigid member and the right-most angled member, a fourth rigid member having left-most and right-most ends, said fourth rigid member being joined at the junction of the left-most horizontal rigid member and the left-most angled rigid member, a fifth rigid member having left-most and right-most ends, said fifth rigid member being joined at the junction of the right-most horizontal rigid member and the right-most angled rigid member, a left-most pad support rigid member, said left-most pad support rigid member being joined with the fourth rigid member and the third rigid member, a right-most pad support rigid member, said right-most pad support rigid member being joined with the fifth rigid member and the third rigid member.

4. An exercise device for performing muscle building exercises using an exerciser's body weight as resistance comprising:

a frame, said frame having one or more pairs of coaxial holes capable of accepting bolts or pins for mounting the exercise device in an elevated position, said frame having a first rigid member having left-most and right-most ends, said frame having a second rigid member having left-most and right-most ends, said second rigid member being parallel to the first rigid member, said frame having a left-most rigid member having a top end and a bottom end, said top end of the left-most rigid member being joined to the left-most end of the first rigid member, said bottom end of the left-most rigid member being joined to the left-most end of the second rigid member, said frame having a right-most rigid member having a top end and a bottom end, said top end of the right-most rigid member being joined to the right-most end of the first rigid member, said bottom end of the right-most rigid member being joined to the right-most end of the second rigid member, said frame having a left-most horizontal rigid member joined to the bottom end of the left-most rigid member and joined to the left-most end of the second rigid member, said left-most horizontal rigid member forming a right angle with both the left-most and second rigid members, said frame having a right-most horizontal rigid member joined to the bottom end of the right-most rigid member and joined to the right-most end of the second rigid member, said right-most horizontal member forming a right angle with both the right-most and second rigid members, said frame having a left-most angled rigid member joined to the left-most end of the first rigid member and the left-most horizontal rigid member, said from having a right-most angled member joined to the right-most end of the first rigid member and the right-most horizontal rigid member, said frame having a third rigid member having left-most and right-most ends, said left-most end of the third rigid member being joined to the left-most angled rigid member and the right-most angled member, said frame having a fourth rigid member having left-most and right-most ends, said fourth rigid member being joined at the junction of the left-most horizontal rigid member and the left-most angled rigid member, said frame having a fifth rigid member having left-most and right-most ends, said fifth rigid member being joined at the junction of the right-most horizontal rigid member and the right-most angled rigid member, said frame having a left-most pad support rigid member, said left-most pad support rigid member being joined with the fourth rigid member and the third rigid member, said frame having a right-most pad support rigid member, said right-most pad support rigid member being joined with the fifth rigid member and the third rigid member, a fixed support pad, said support pad being mounted onto said left-most pad support rigid member and said right-most pad support rigid member, a curl bar, said, curl bar being mounted onto the frame in a fixed position above the support pad.

* * * * *